US006931756B2

(12) United States Patent
Morgan et al.

(10) Patent No.: US 6,931,756 B2
(45) Date of Patent: Aug. 23, 2005

(54) COMBINATION DEHYDRATOR AND CONDENSED WATER DISPENSER

(76) Inventors: Michael Morgan, P.O. Box 803, Dripping Springs, TX (US) 78620; Janet Morgan, P.O. Box 803, Dripping Springs, TX (US) 78620

( * ) Notice: Subject to any disclaimer, the term of this patent is extended or adjusted under 35 U.S.C. 154(b) by 0 days.

(21) Appl. No.: 10/167,966

(22) Filed: Jun. 10, 2002

(65) Prior Publication Data

US 2003/0097763 A1 May 29, 2003

Related U.S. Application Data

(60) Provisional application No. 60/296,472, filed on Jun. 8, 2001.

(51) Int. Cl.[7] ..... F26B 19/00

(52) U.S. Cl. ..... 34/202; 165/61; 34/71; 34/69; 34/73

(58) Field of Search ..... 34/202, 201, 69, 34/71, 76, 197, 73, 196, 77, 78, 86; 62/91, 92, 93; 165/58, 59, 60, 61

(56) References Cited

U.S. PATENT DOCUMENTS

| | | | | | |
|---|---|---|---|---|---|
| 2,805,560 | A | | 9/1957 | Beresford | |
| 2,996,897 | A | | 8/1961 | Grimes | |
| 3,035,418 | A | | 5/1962 | Wright | |
| 3,299,651 | A | | 1/1967 | McGrath | |
| 3,675,442 | A | | 7/1972 | Swanson | |
| 4,027,727 | A | * | 6/1977 | Pullens | 165/48 |
| 4,152,842 | A | * | 5/1979 | Laughlin | 34/196 |
| 4,204,956 | A | | 5/1980 | Flatow | |
| 4,255,937 | A | | 3/1981 | Ehrlich | |
| 4,351,651 | A | | 9/1982 | Courneya | |
| 4,484,315 | A | | 11/1984 | Hall | |
| 5,106,512 | A | * | 4/1992 | Reidy | 210/744 |
| 5,119,571 | A | * | 6/1992 | Beasley | 34/446 |
| 5,149,446 | A | | 9/1992 | Reidy | |
| 5,203,989 | A | | 4/1993 | Reidy | |
| 5,227,053 | A | | 7/1993 | Brym | |
| 5,235,906 | A | * | 8/1993 | Hsu | 99/483 |
| 5,250,258 | A | | 10/1993 | Oh | |
| 5,259,203 | A | | 11/1993 | Engel | |
| 5,301,516 | A | * | 4/1994 | Poindexter | 62/126 |
| 5,315,830 | A | | 5/1994 | Doke | |
| 5,366,705 | A | | 11/1994 | Reidy | |
| 5,398,517 | A | | 3/1995 | Poindexter | |
| 5,484,538 | A | | 1/1996 | Woodward | |
| 5,517,829 | A | | 5/1996 | Michael | |
| 5,553,459 | A | * | 9/1996 | Harrison | 62/93 |
| 5,564,601 | A | * | 10/1996 | Cleland et al. | 222/129.1 |
| 5,669,221 | A | | 9/1997 | LeBlue | |
| 5,701,749 | A | | 12/1997 | Zakryk | |
| 5,704,223 | A | | 1/1998 | MacPherson | |
| 5,845,504 | A | | 12/1998 | LeBleu | |
| 5,857,344 | A | | 1/1999 | Rosenthal | |
| 6,029,461 | A | | 2/2000 | Zakryk | |
| 6,058,718 | A | | 5/2000 | Forsberg | |
| 6,182,453 | B1 | | 2/2001 | Forsberg | |
| 6,390,378 | B1 | * | 5/2002 | Briscoe, Jr. et al. | 236/44 |

* cited by examiner

*Primary Examiner*—Henry Bennett
*Assistant Examiner*—Camtu Nguyen
(74) *Attorney, Agent, or Firm*—Kleinberg & Lerner

(57) ABSTRACT

A portable, atmospheric dehydrator and water condenser for dehydrating fruits and vegetables while producing pure atmospheric condensation from humidity found in the air and purifying the water for dispensing and drinking purposes.

28 Claims, 8 Drawing Sheets

COMBINATION DEHYDRATOR AND CONDENSED WATER DISPENSER

Applicants claim priority to provisional application No. 60/296,472 filed Jun. 8, 2001.

BACKGROUND OF THE INVENTION

1. Field of the Invention

The invention relates to dehydrators and water condensers, and, more particularly, a combined dehydrator and condensed water dispenser.

2. Related Art

There is a worldwide crisis in our potable water supply. The World Bank has estimated that $600 billion must be invested in water delivery systems. The United Nations has announced a worldwide water shortage and has predicted that, by the year 2010, this crisis could be a catalyst for conflicts and wars.

Many countries of the world already have an inadequate water supply. Usable water supplies have been reduced by pollution and sewage waste.

Various means have been suggested by treating water, such as with chemicals such as chlorine or other halogens. However, the by-products of such treatment may be toxic and the result in further contamination. Treated municipal water supplies may be contaminated with lead leading to health problems in drinking such water.

Various attempts have been made to come up with a system for dehydrating fruits and vegetables and/or condensing and purifying the water produced in such systems. Known prior art patents relating to such systems are the following:

U.S. Patent Documents

| | | | |
|---|---|---|---|
| 3035418 | May 1962 | Wright | 62/176. |
| 3675442 | July 1972 | Swanson | 62/285. |
| 4204956 | May 1980 | Flatow | 210/87. |
| 4255937 | March 1981 | Ehrlich | 62/264. |
| 5106512 | April 1992 | Reidy | 210/744. |
| 5149446 | September 1992 | Reidy | 210/744. |
| 5203989 | April 1993 | Reidy | 210/137. |
| 5227053 | July 1993 | Brym | 210/143. |
| 5259203 | November 1993 | Engel et al. | 62/150. |
| 5301516 | April 1994 | Poindexter | 62/126. |
| 5315830 | May 1994 | Doke et al. | 62/3. |
| 5484538 | January 1996 | Woodward | 210/767. |
| 5517829 | May 1996 | Michael | 62/272. |
| 5553459 | September 1996 | Harrison | 62/93. |
| 5669221 | September 1997 | LeBleu et al. | 62/92. |
| 5701749 | December 1997 | Zakryk | 62/93. |
| 5704223 | January 1998 | MacPherson et al. | 62/3. |
| 5845504 | December 1998 | LeBleu | 62/92. |
| 6029461 | February 2000 | Zakryk | 62/93. |
| 6058718 | May 2000 | Forsberg | 62/92. |
| 6182453 | February 2001 | Forsberg | 62/92. |

Not one of the systems disclosed in the foregoing patents incorporates the specific function of extracting the humidity from the ambient air and using that air as a means to be used and designed as a dehydrator.

The above patents disclose large and small water condensing units, none realizing the benefits of heated dehydrated air as a source of preserving fruits and vegetables, and none conveniently operate all functions with a remote control.

For example, U.S. Pat. No. 5,106,512 discloses a fixed-position, large-volume, high-rate generator suitable for supplying drinking water to an entire office building, laundry, etc. The device is described as "having ducts for bringing this supply of ambient air to the device and for releasing the air back outside the device after it has been processed." The attached, permanent "ductwork" is characterized further as "extending through an outside wall of the structure or dwelling." While sensors, indicators, interlocks, alarms for the UV lamps, air filters and water filters are mentioned briefly in Reidy, other major components of the apparatus are usually characterized by single-word descriptions such as "air filter element", "evaporator coils", "condenser coils", etc. In Reidy's patents mentioned above, the drain is located on the base of his water generator, a position which makes the drains completely unsuitable for dispensing water unless the machine is placed on legs or mounted in a cabinet. Reidy (512) teaches two passes of water past an ultraviolet light tube to kill bacteria. Reidy (512) has a number of additional limitations and shortcomings: the user must set the humidistat and thermostat. Reidy makes no provision for insect or rodent proofing of the cabinet. The gravity flow water filter of Reidy (512) is located under the collection pan and is severely limited in both flow rate and minimum pore size by the gravity-feed pressure head.

In U.S. Pat. No. 5,301,516 to Poindexter, there is no germicidal light or a remote collection diverter valve. A drain is shown in FIG. 2 but none in FIG. 1. The drain is shown on the bottom of the apparatus which, if on the floor, is essentially inoperable and, if raised on a stand, makes a top-heavy unit which would require permanent wall anchors. Poindexter further claims a stainless steel air-cooling coil and collection pan which adds significantly to the cost of manufacturing and does not specify the specific type of stainless steel, 314L, which is required for water handling in production facilities. The specification goes into great detail on the types of chemicals usable to clean areas which contact the water.

In U.S. Pat. No. 5,259,203 to Engle et al., there are essentially two tandem dehumidifiers. A second-stage compressor with its condenser coil immersed in the storage tank produces heated water. One familiar with the art realizes that such heated water would never reach 75° C. A further problem of locating the condenser coil in the storage tank is that it prevents removal of the tank for cleaning without opening the refrigerant system. Still further maintenance problems arise from the positioning of drains, i.e., there are no external dispensing valves and the drain valves are poorly located for replacing the valves because of the limited access inherent in their location.

In U.S. Pat. No. 5,553,459 to Harrison, a UV lamp tube is used to treat the discharge water stream; this indicates that bacteria and/or algae may be growing within the unit or its plumbing connections. This unit also must be primed initially with approximately 10 liters of start-up water which can be a source of initial contaminants, such as volatile organic compounds (VOC), which are neither removed nor broken down by either UV radiation or granular carbon charcoal. In Harrison, the compressor operates to maintain a cold set-point temperature within the water reservoir, i.e., the compressor operates to cool the fluid remaining in the reservoir even when the device is not actively producing water condensate.

In U.S. Pat. No. 3,675,442 to Swanson, some of the same deficiencies as in Harrison (459) are present. Further, Swanson lacks an air filter or a UV disinfecting system. While Swanson's discharge device is shown in one figure, the location and operating parameters are not specified.

Brym (U.S. Pat. No. 5,227,053) provides a UV-activated catalyst water purifier/dispenser for tap water (well or public supply), which can be installed below the counter or enclosed in a cabinet. This unit merely treats water supplied to it, and, in the process, a certain portion of the incoming flow is diverted to waste.

U.S. Pat. No. 5,517,829 to Michael discloses a device for producing and filtering "drinking" water across "activated charcoal" and a "plastic mesh microspore filter." It is not and is not compliant with NSF-53 relative to VOC removal. Further, it has no provision for continuing circulation of water in order to maintain purity, or a thermostat sensor to prevent formation of ice on cooling surfaces of the enclosed atmospheric chilling collection coils.

Thus, all of the prior art patents cited above use a typical refrigerant deicer system to keep their evaporators from freezing under low condensate flow rates, which can occur with cool ambient air. For example, Reidy (512) shows water production stopping at about 10° C. This limitation occurs because: (a) obtaining condensate is inefficient, (b) condensation is not cost effective at such low temperatures and (c) the evaporator tends to freeze over at lower temperatures. This limitation also occurs because of the design of the water-generating device using a typical hot-gas bypass deicer which is not computer controlled for temperature/humidity combinations. All of the devices cited above are large capacity refrigerant gas dehumidifiers. The refrigerant gas from the compressor cools an evaporator coil and, when ambient air is passed by the coil, moisture condenses out and drips to a collector below. When operated over extended periods or in cooler temperatures, the evaporator tends to freeze over due to low flow rate of condensate. In this situation, the compressor is designed to switch over to hot-gas bypass mode. A thermostat and/or humidistat control assists in determining when the compressor switches over. This on/off cycle during cooler temperatures drastically reduces production of water until the compressor eventually stops when the temperature of the incoming air is too low.

In U.S. Pat. No. 6,182,453 to Forsberg, Forsberg claims the ability to connect the portable unit to city water supply in times of low humidity. Forsberg does not have a sediment filter, which is necessary for city or well water supplies. Forsberg has a single charcoal filter, which, if hooked up to city water, will clog the filter in a very short time therefore ruining the filter and adding no future protection.

In U.S. Pat. No. 5,704,223 to MacPherson et al., there is described a thermoelectric, TE cooler attached to a medicine-cooler bag containing an insulin vial. The drug vial cooler disclosed is a non-circulating, closed, small-volume, sterile fluid system.

In U.S. Pat. No. 5,701,749 to Zakryk, there is described a water cooler with a TE cooling junction integrated into the side walls of the holding tank. Zakryk's U.S. Pat. No. 6,029,461 describes and claims the water cooler of his '749 patent which further includes a water filter assembly.

In U.S. Pat. No. 5,315,830 to Doke et al., there is described a TE apparatus integrated into an insulated picnic or food-transport container.

There is thus a need for a combined dehydrator and condensed water dispenser which dehydrates fruits and vegetables preserving them for future consumption and thus benefits those who rely on seasonal crops as a main food source. Such a device should be portable and the water extracted from the humidity taken out of the ambient air should make the air dry enough to dehydrate fruits and vegetables and the recovered water should become a valuable drinking source. Such a system should act as a food and water source and be able to operate off of a solar panel.

INVENTION SUMMARY

It is an object of this invention to provide a system for dehydrating fruits and vegetables while purifying the water extracted from the humidity making it potable.

It is a further object of this invention to provide such a combined dehydrator and condensed water dispenser that is portable and capable of operating off of solar panels.

It is still further an object of this invention to provide a method for carrying out the foreign objects. This and other objects are preferably accomplished by providing a portable, atmospheric dehydrant and water condenser for dehydrating fruits and vegetables while producing pure atmospheric condensation from humidity found in the air and purifying said water for dispensing and drinking purposes.

DETAILED DESCRIPTION OF THE PREFERRED EMBODIMENTS

Figure 1:
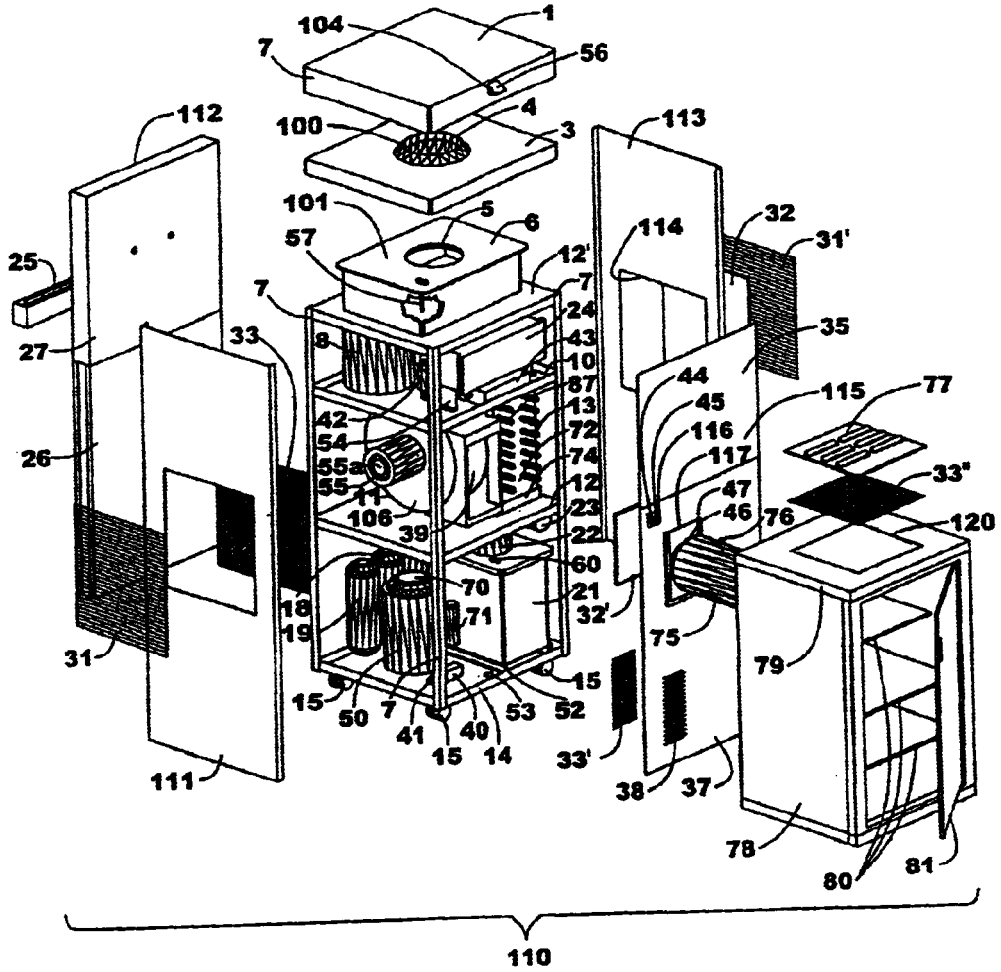
FIG. 1 is an exploded view of a combination dehydrator and condensed water dispenser apparatus in accordance with the teaching of the invention.

Referring now to FIG. 1 of the drawings, a combination dehydrator and condensed water dispenser apparatus 110 is shown having a top lid 1, a second lid 3 underneath lid 1, and an upstanding flanged collar 4 surrounding an opening 100 in lid 3 for receiving the top of a bottle of water (not shown) therethrough.

A holding tank 6 is provided below lid 3 on upper shelf 12' having a centrally located aperture 5 provided in top wall 101 of tank 6. Lid 1 has downwardly extending sidewalls 102, at least one of which has a flap 56 covering an electric socket 104, such as a 12-volt outlet. A plurality of bio-stimulator probes 89 (see FIG. 3) may be coupled to switch 104 via electric connection 103. Second lid 3 may also have downwardly extending side flaps (not shown).

As seen in FIG. 1, a portion of tank 6 is cutaway for purposes of illustration to show a magnetic float switch 57 for reasons to be discussed further hereinbelow. Apparatus 110 includes a main upstanding frame 7 having a first upper shelf 10 below tank 6, a second shelf 12 below shelf 10 and a lower bottom shelf 14. A plurality of wheels or rollers 15 may be provided on the underside of shelf 14 for wheeling the apparatus 110.

A suitable master computerized control system 24, retained by brackets 54, for operating apparatus 110, as will be discussed, is mounted on shelf 10. Also mounted on shelf 10 is an insulation unit 8, preferably of styrofoam, for a cold water dispenser as will be discussed. A conventional mineral dispenser 42 is disposed between unit 8 and control system 24. A conventional AD/DC/inverter 43 may be mounted on shelf 10 below system 24 for a 12-volt adapter.

A whisper quiet fan 55 is mounted in housing 11 having coupling means 55*a* for connection to a fan motor (not shown). The housing 106 for fan 55 is insulated and has a whisper quiet fan exhaust 39.

Housing 11 is associated with an atmosphere condensation collection drip tray 74 having a heat exchanger 13 with a plurality of spaced FDA coated evaporator fans 72 and atmospheric chilling collection coils 87.

Figure 5:
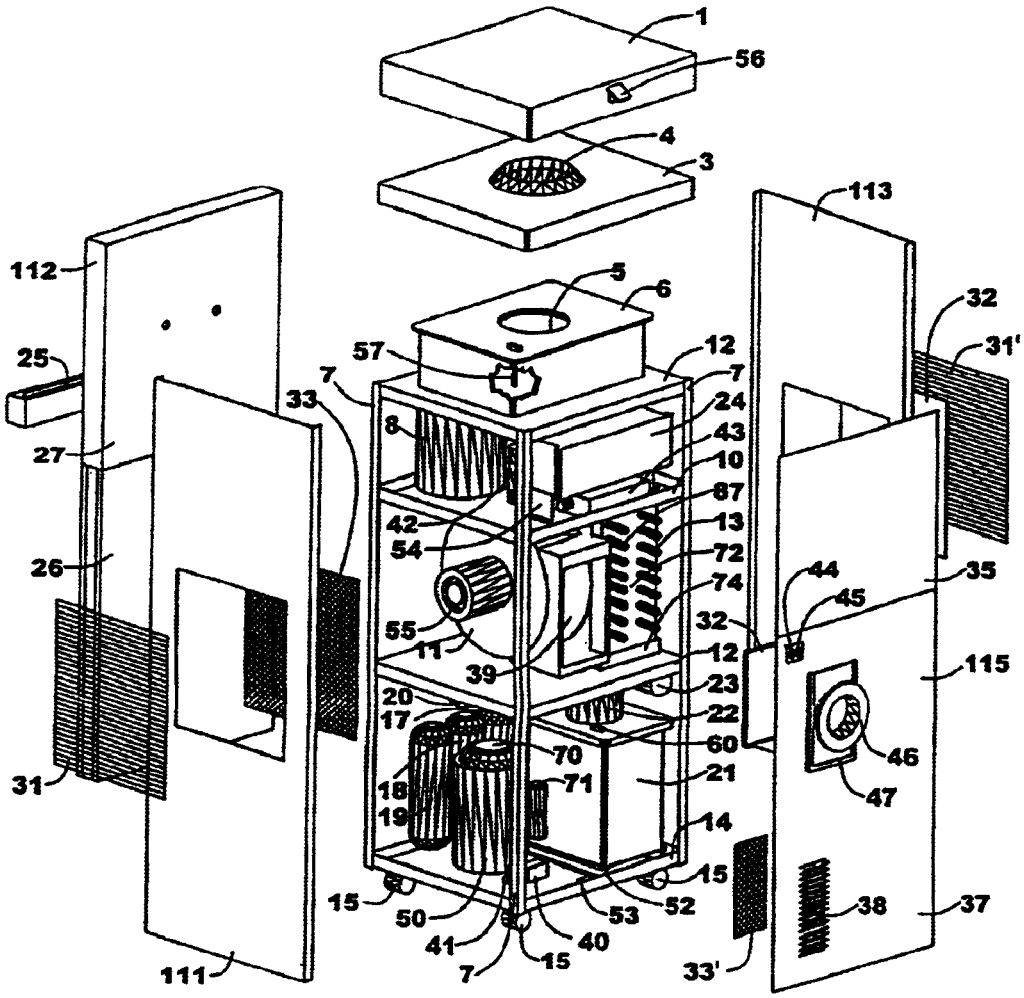
Figure 6:
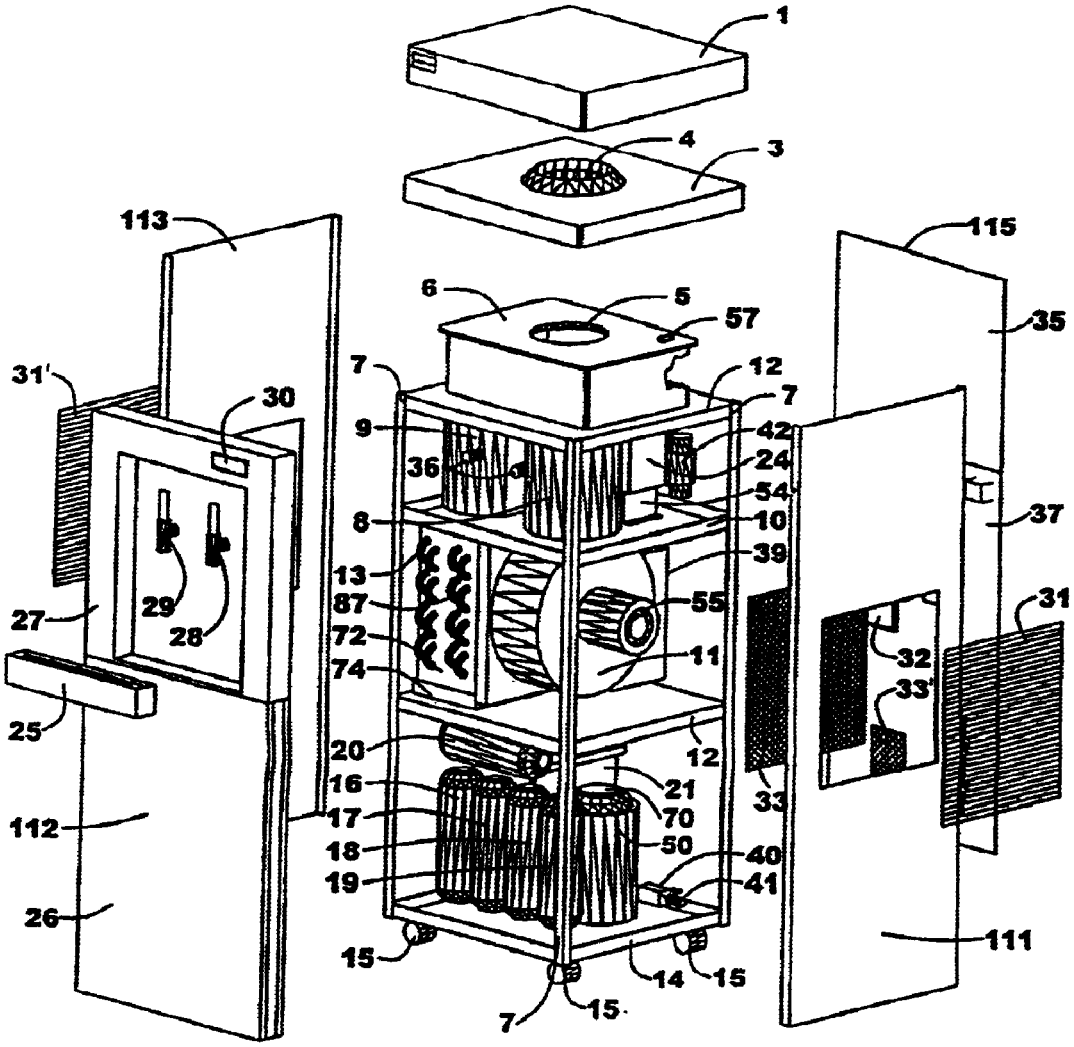

A plurality of filters is mounted on bottom wall 14. As will be discussed, filter 19 is the $4^{th}$ stage of a five stage Pi filter system, and filter 18 is the $3^{rd}$ stage of the five stage Pi filter system (see also FIG. 3). An insulated compressor 50 (see FIGS. 1, 5 and 6) is mounted on bottom wall 14 and an electro-solenoid 71 (FIG. 1) is mounted outside of an anti-bacterial holding tank 21. A granular charcoal filter 22 is mounted on top of tank 21.

If desired, a solenoid inlet 40 having a ball valve 41 may also be mounted on bottom wall 14 for providing a hook up to an external water supply—not shown—such as a city water supply.

As seen in FIG. 1, tank 21 may be mounted on tracks 52 so that it can be slid in and out of apparatus 110 for servicing or cleaning or the like. A releasable locking lever 53 may be provided on tracks 52 for locking tank 21 in position. An ultraviolet light housing 23 may be provided underneath shelf 12.

A first side panel 113 is provided having a rectangular cutout area 111 adapted to be covered by a right left side vent 31. On the other side of panel 34, an insect and rodent proof screen 33 may be provided.

A front panel 112 is provided having a first upper panel 27 and an integral second lower panel 26, which may be insulated. A drip tray 25 is also provided for reasons to be discussed.

A second side panel 113 is provided also having a rectangular opening 114 adapted to be covered on the exterior by a first air intake filter 32, then by a right side vent 31'.

Back panel 115 has a first upper panel 35 and a second integral lower panel 37. Lower panel 35 has a switch panel 116 with a first on-off switch 44 and a second high, low fan speed control switch 45. Lower panel 37 also has a lower vent 38 and an apertured panel 117 having an opening communicating with a flexible duct 75. Duct 75 is coupled to panel 117 by a flanged connection 46 (see also FIGS. 4 and 5) and has an internal baffle 76 (only the actuating lever being visible in FIG. 1). A slide-in, slide-out track 47 is provided for holding the panel to wall 47. Another rodent and insect proof screen 33 may also be provided aligned with lower vent 38 when assembled. Also, an air intake filter 32' may be associated with the apertured panel 117.

A dehydrator cabinet 78 is provided having a plurality of side panels 78 and a vented top wall 79. An opening 120 is provided on top wall 79 adapted to be closed off by a rodent and insect proof screen 33" and a louvered vent 77.

Cabinet 78 has a plurality of interior spaced shelves 80 and the interior may be closed off by a hinged door 81.

Figure 2:
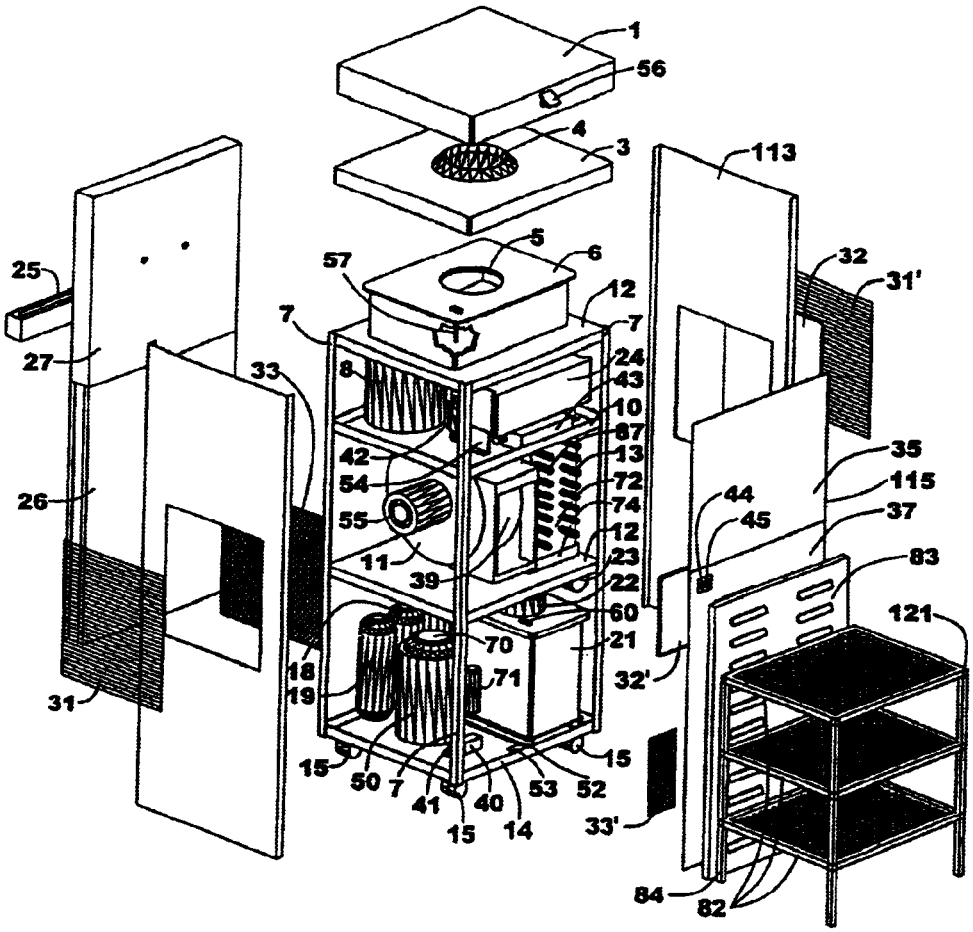
FIG. 2 is a view similar to FIG. 1 showing the dehydrating stand in place of the dehydrator cabinet of FIG. 1.

Referring now to FIG. 2, instead of cabinet 78, the cabinet 78 and duct 75 may be removed and an open air vented dehydrating removable louvered panel 83 may be provided between panel 37 and an air dehydrator 121. Dehydrator 121 may have a plurality of spaced screen air dehydrating shelves 82 supported by four side legs 84.

Figure 3:
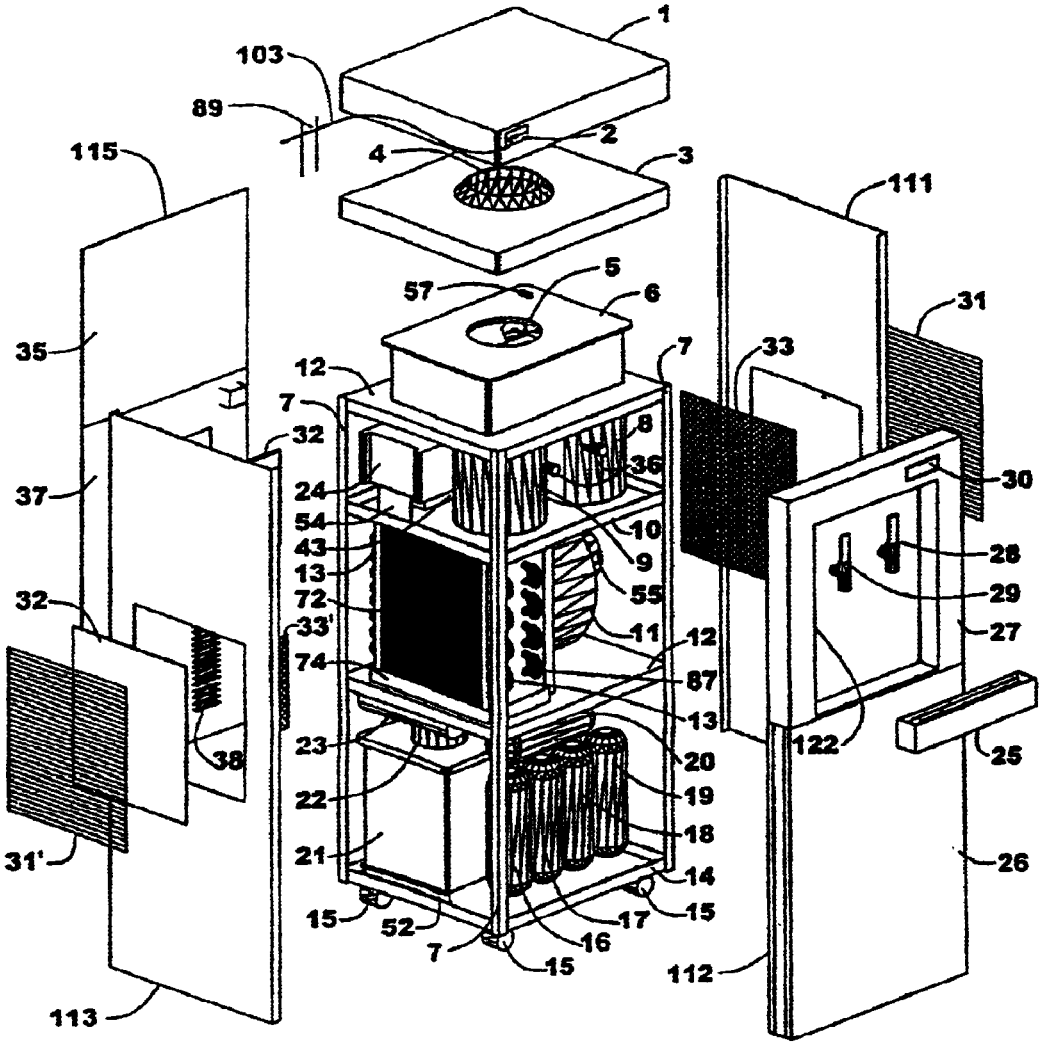
FIGS. 3 through 6 are alternate exploded views of the apparatus of FIG. 1.

As seen in FIG. 3, drip tray 25 is adapted to be mounted to panel 27 inside of a recessed opening 122 below a pair of spaced water faucets 28, 29 (hot and cold). Also seen in FIG. 3 is a conventional colloidal silver pulsar 2 associated with top panel 1 and an insulated hot water dispenser 9 rearwardly of dispenser 8 as seen in FIG. 3. Also seen in FIG. 3, on bottom shelf 14, is stage 1of the five stage Pi filter system in the form of a sediment filter 16 and stage 5 of the five stage Pi filter system in the form of Pi filter 20. An LED computer display 30 is provided at top of panel 27.

Figure 4:
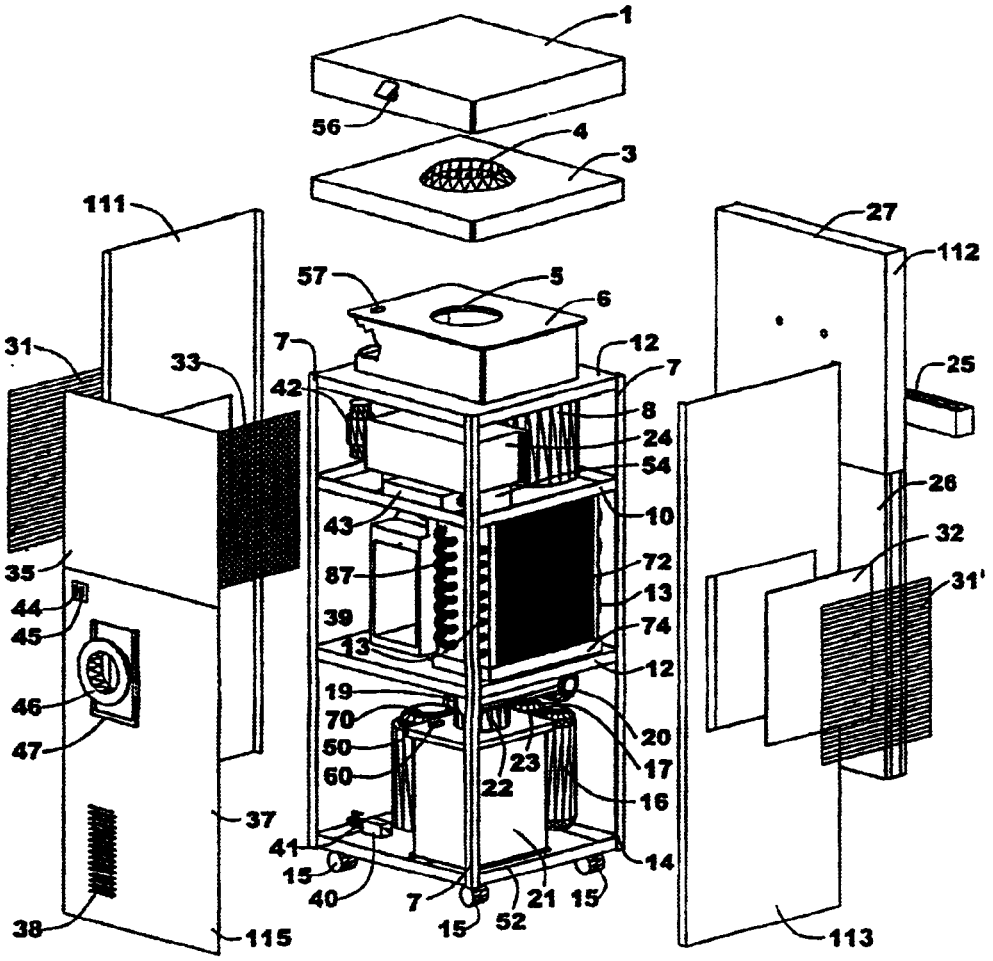

As seen in FIG. 4, stage 2 of the five stage Pi filter system is shown as filter 17, which may be a 0.05 micron matrix+1 filter.

Figure 7:
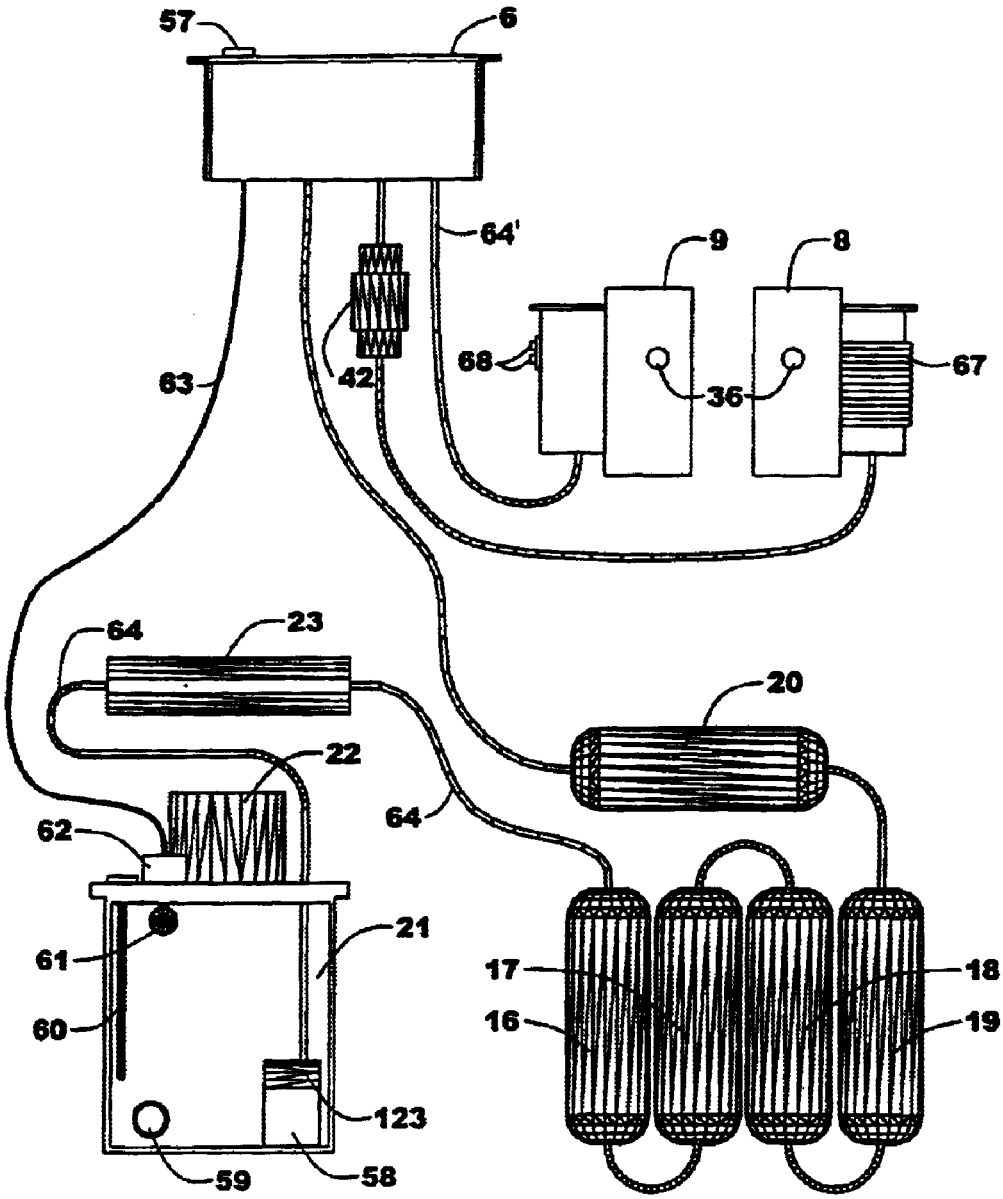
FIG. 7 is a diagrammatic view illustrating the flow process of the system.

Referring now to FIG. 7, a pair of water dispenser faucet connection extensions 36 are provided at cold water dispenser 8 and hot water dispenser 9 (see FIG. 3—the extensions 36 line up with the hot and cold faucets 28, 29 when the sides are assembled). Holding tank 21 has a pump 58 and an ozoneator 59. Pump 58 has an internal piston 123. An aquarium circulation safety float 61 is provided coupled to a tube insert 62 having tubing 63 coupled thereto. An anti-bacterial tubing 64 extends from pump 58 to UV light 23, then from light 23 to filter 16. Tubing 64 extends through filter 16, out the bottom thereof and into filter 17. From there, tubing 64 extends into filter 18, out the bottom thereof and into filter 19. From there, tubing 64 extends through filter 20 and up to the anti-bacterial holding tank 6.

Tubing 64 then extends out of tank 6, through inverter 42 and into cold water dispenser 8. Copper tubing 67 surrounds dispenser 8. Hot water dispenser 9 is coupled to tank 6 through tubing 64'. A magnetic float switch 60 is provided in tank 21 and, a heating unit 68 is associated with hot water dispenser 9.

Figure 8:
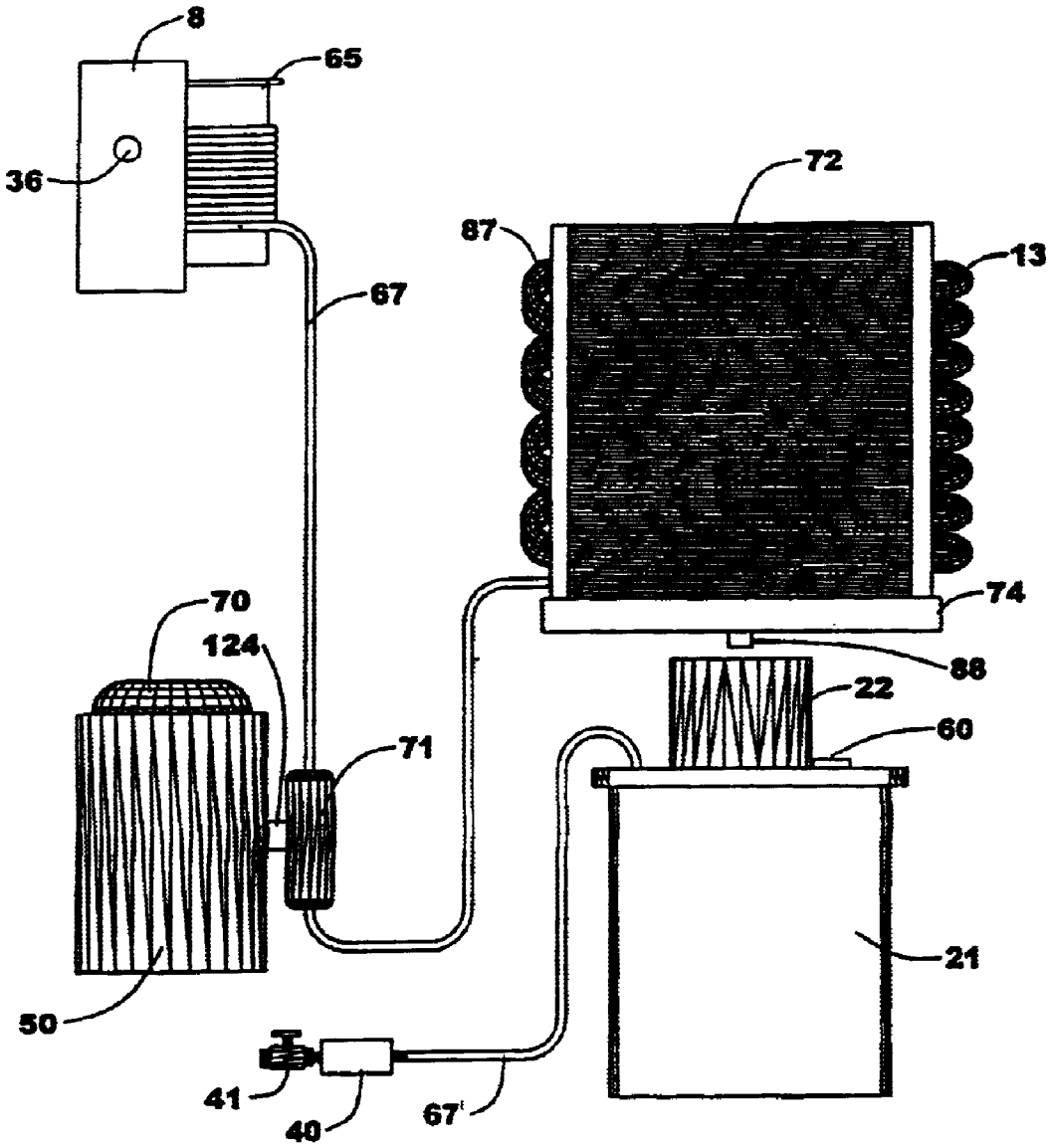
FIG. 8 is a diagrammatic view illustrating the interrelationship of certain parts of the apparatus of FIGS. 1 to 7.

Referring now to FIG. 8, compressor 70 is shown insulated by jacket 50 and coupled, via tubing 124, to solenoid 71. Solenoid 71 is in turn coupled via tubing 67 to cold water dispenser 65. It can be seen in FIG. 8 that tubing 67 surrounds dispenser 65 which is insulated by insulation 8. One of the faucet extensions 36 is shown fluidly connected to dispenser 65.

Tubing 67 extends from solenoid 71 to evaporator 72. A drip tray funnel 88 is provided at the bottom of collection drip tray 74.

Fluid is thus passed through filter 22 and into tank 21. Tubing 67' is fluidly coupled at one end to tank 21 and at the other end to inlet 40 which is controlled by ball valve 41.

In operation, referring to FIG. 1, the apparatus 110 is turned on via switch 44 actuating fan 55.

Air is drawn via fan 55 inwardly through vent 31 across the atmospheric chilling collection coils 87. As the compressor 70 chills the coils 87, the heat exchange 13 builds up inside the apparatus housing. The fan 55 then dispenses the hot air out outlet 39 through the outlet filter 32' at a controlled flow rate using a baffle 76 inside the flexible duct 75. This creates an open air vented dehydrating system via louvered panel 83 on the open air adjustable shelves 82 (FIG. 2) so as to dehydrate fruits, vegetables, and flowers and dry the same or any other artifacts on these shelves. One can also place fruits, vegetables, and flowers and dry any other artifacts inside the enclosed dehydrator cabinet 78 (FIG. 1), which also has three shelves 80 which shelves may also be screened. The enclosed unit 78 has a vented top 79 with a rodent and insect screen 33" and a top louvered vent 77. With the heated air going into the cabinet 78, and the door 81 closed, fruits, vegetables, and the like dehydrate much quicker. The flow of heated air can be slowed down and sped up by controlling the baffle 76 located inside the flexible duct 75. The flanged connection for the dehydrator duct 46 attaches to the back panel 37 by sliding in to the slide in-slide out track 47 mounted on the back panel 37. The duct 75, which can be cut to length to custom fit where the dehydrator sits, attaches to the flanged connection for the dehydrator duct 46. This duct 46 then attaches to the back of the dehydrator cabinet 78 or attaches to the back of the open air vented dehydrating removable louvered panel 83 (FIG. 2). The open air vented dehydrating removable louvered panel 83 may be attached directly to the back panel 37 by sliding in the slide in-slide out tracks 47 (not visible in FIG. 2) or can be attached to the flexible duct 75 in any suitable manner, e.g., a portable flange (not shown) on the rear thereof.

The whisper quiet fan 55 (which preferably is quiet enough to be called "whisper quiet") draws air from the side inlet vent in panel 34 through an air filter system 32 and across the atmospheric shilling collection coils 87. As the compressor 70 chills the coils 87, atmospheric condensation builds up no the coated surface of the evaporator fins 72 (which may be FDA-approved). The atmospheric condensation begins to flow downwardly by way of gravity flow into the collection drip tray 74 and then downwardly through the drip tray funnel 88 (FIG. 8) continuing to gravity-drip into and through the granular charcoal filter 22 and finally into the first antibacterial collection holding tank 21.

The first antibacterial collection holding tank 21 is located at the bottom of the unit and is mounted on sliding tracks 52 (FIG. 1) for ease of removal for cleaning by pushing down on the locking lever 53 and sliding the first antibacterial collection holding tank 21 out and cleaning it. It can be reinstalled by sliding it back on the tracks 52 and securing the locking lever 53. The first antibacterial collection holding tank 21 may be a nearly completely closed 2½ gallon container that easily fits into a kitchen sink for easy cleaning. The pump 58 (FIG. 7) located inside the first antibacterial collection holding tank 21 is turned off and on by a combination of the magnetic float switch 60 located inside the first antibacterial collection holding tank 21 and the magnetic float switch 57 in the top antibacterial collection holding tank 6. When the water gets low in the top antibacterial collection holding tank 6, the magnetic float switches 60 lowers and calls for water from the first antibacterial collection holding tank 21 lowering the water in the first antibacterial collection holding tank 21 thereby lowering the level of the magnetic float switches 60 which in turn activates the compressor 70 (FIG. 8) and the fan 55 (FIG. 1) to draw air from the side inlet vent in panel 34 through an air filter system 32 and across the atmospheric chilling collection coils 87.

As the pump 58 (FIG. 7) runs, it draws water from the lower tank and pumps it through the antibacterial tubing 64 where it first passes through enclosed aluminum casing holding ultraviolet light 23 killing 99.9% of bacteria and viruses. Then the water passes through the first of a five-stage Pi filtration system. Sediment filter 16 is seamlessly connected to the second filter 17 in line, the 0.05 micron matrix+one filter 17 then seamlessly connecting to the third filter in line, the ste-o-tap (U/F) filter 18 then seamlessly connecting to the fourth filter in line, the post carbon filter 19, then seamlessly connecting to the fifth filter in line, the Pi filter 20. The water then goes into the top antibacterial collection holding tank 6 raising the magnetic float switch 57 up in the tank and shutting off the compressor 70 (FIG. 8). The water is always moving creating an aquarium-style continuous circulation.

After the water goes from the bottom to the top tank, an antibacterial tube 63 allows the water to gravity flow from the top tank 6 back down to the bottom tank 21 and the continuous circulation goes on. When the tank is full, a full tank indicator light on the LED read out 30 (FIG. 6) of the unit comes on to let one know the tank is full. Even when the tanks are full the continuous aquarium-style circulation continues with the pump 58 (FIG. 7) running. The water in the top tank 6, in a gravity motion, flows seamlessly through the antibacterial tubing 64, then seamlessly through the mineral container 42 housing minerals thereon and into the cold water dispenser 65. The mineral container 42 is located beside the computer control system 24 (FIG. 1) and is easily accessed behind the easily removable back panel 35. The mineral container 42 (FIG. 7), may be connected in two parts with twist-on threads connecting the two parts together which are sealed with an FDA-approved rubber sealed gasket to complete a seamlessly tight connection. This assures the ease of replacement or removal of such the minerals. Cold water is dispensed out of the cold water container seamlessly through the dispenser faucet connection extensions 36 and out the cold water dispenser faucet 28 (FIG. 3). The cold water in the dispenser 8 is accomplished by the use of the compressor 70 (FIG. 8) with an internal electro-solenoid 71 attached to an in-line thermostat monitoring the temperature on the cold water dispenser 8. When the cold water rises above the desirable temperature of 40° F., the compressor 70 engages bypassing the atmospheric chilling collection coils 13 (FIG. 1) and passing seamlessly through the copper coils 67 (FIG. 7) wrapped evenly around the cold water dispenser 8.

The water in the top tank 6 (FIG. 7), in a gravity motion, flows seamlessly through the antibacterial tubing 64' seamlessly into the hot water dispenser 66. Hot water is dispensed out of the hot water container seamlessly through the dispenser faucet connection extensions 36 and out of the hot water dispenser faucet 29 (FIG. 3). The heating of the water in the dispenser 9 is accomplished by the use of a heating unit 68 (FIG. 7) which senses the temperature of the collected water within the container 66 and engages if the temperature falls below the desired temperature of 175° F. to reheat the contained water to the desired temperature of 190° F. The internal electro-solenoid 71 (FIG. 8), in conjunction with the compressor 70, is controlled atmospherically by the thermostat and humidistat in the computer 24, as seen on the LED readout 30. This operates together to gauge the temperature and humidity of the atmospheric dehydrator and water condenser dispenser apparatus 110, as controlled by a user thereof, and maximize the collection of concentrated humidity. The electro-solenoid 71, in conjunction with the compressor 70, also controls the flow of the EPA-compliant refrigerant, the enclosed atmospheric chilling collection coils 13 being fitted with a thermostatic sensor in the internal electro-solenoid 71, which is automatically regulated. This shuts the compressor 70 off since it is attached to the enclosed atmospheric chilling collection coils 13 (FIG. 1) to prevent formation of ice on cooling surfaces of the enclosed atmospheric chilling collection coils 13.

The removable top lid 1 of the machine allows access to the second top 3, which is designed to hold a 5-gallon bottle of water holder in case of low humidity, that can be chilled and dispensed from the normal working operations of the dehydrating water-making unit. One can also hook the apparatus up to city water by connection to the ball valve 41 (FIG. 8) located on the bottom shelf 14. The city water enters the unit through a solenoid 40 and into the first antibacterial collection holding tank 21 located at the bottom of the unit. From there, it follows the path described as the pump 58 pumps the water to the top tank 6 (FIG. 7).

The colloidal silver pulsar 2 (FIG. 3) located in the top lid 1 is flush mounted to the face of the top lid 1 with the controls of the colloidal silver pulsar 2 on the face thereof. The plug-in male jack 104 may have a two-foot long cord to plug into a female input on the face of the colloidal silver pulsar 2, which hooks it up to the external set of bio-stimulator probes 89 (FIG. 3). When the bio-stimulator probes 89 are inserted into a glass of water, and the colloidal silver pulsar 2 is turned on, it serves a dual function unit being both a bio-stimulator ionic and colloidal silver generator. The colloidal silver pulsar 2 generates the finest quality ionic colloidal silver at a rate of 3–5 ppm (parts per million) in 20 minutes for 16 ounces of distilled water with an Ionic colloid silver particle size that is mostly ions, with colloidal particles in the range of 0.005–0.015 microns. In the electrolysis process, water splits into hydrogen and oxygen. Oxygen comes off the positive (+) electrode and interacts with silver ions, which in turns creates silver oxide and oxygen.

The 12-volt inverter adapter 43 (FIG. 1) located under the computer system 24 allows one to plug in anything such as a portable CD player, shaver, cell phone, or anything else that runs off of 12 volts by plugging into the auto-style cigarette light-type insert 56 in the back side of the top lid 1.

The fan speed switch 45 located on the back panel 37 of the apparatus allows one to adjust hi-low fan speeds. An indicator light on the LED display 30 (FIG. 3) on the front of the unit indicates when the tank 21 is full and the apparatus 110 shuts off.

Summary of Four Phases of Hot Air Dehydration

First Phase (Raising the core temperature) In the first phase of raising the core temperature, the product is warmed as fast as possible, without case hardening the product, to within 10 to 20 degrees of the process air temperature. In the counter flow configuration, the wet fruit and vegetables or the like are placed in the cool end and are subjected to very wet air that has lost 20 degrees or more by passing through. This wet air transfers heat very fast and the dry air rises and the humidity stops. This accelerates the transition to the second phase.

Second Phase (Rapid Dehydration) In the second phase, the moisture content of the product is in near free fall. This phase may be located inside the optional portable enclosure to maximize production. As a rule, the moisture content of the process air, when drying most products, measured at the high end, should be 17% to 19%. After the air passes through the dryer the relative humidity at the cool end should be 35% to 50%.

Third Phase (Transition) Transition is the most critical phase. The high rate of moisture release experienced in the second phase slows down to a crawl. Most of the water in the product is gone. Capillary action at the cellular level now provides the majority of the free water being driven off. The evaporative cooling that has kept the core temperature of the product well below the process air temperature slows as well.

Fourth Phase (Bake Out) The final phase is characterized by a slow reduction in the product moisture content. This phase is normally the longest, and depending upon the target moisture content, may include over ½ the dwell time.

The need for the use of separating the atmospheric humidity from the ambient air for purifying dispensing and drinking is well known as discussed hereinabove.

It can be seen that there is disclosed a compact portable, atmospheric dehydrator and water condenser dispenser capable of dehydrating fruits and vegetables or the like, while producing pure atmospheric condensation from the humidity found in the air for dispensing and drinking purposes. A compressed heat exchange has filtered air drawn from the outside humid ambient air across the heat exchange and across the atmospheric chilling collection coils. In this process, the humidity is removed and stored. The dry heated air is then dispensed through vented outlets and across the trays for the purpose of dehydration. Optionally, a portable flexible duct system may be used for the exhausted heated air to travel seamless through the portable duct work into an optional portable enclosure where the primary purpose of the optional portable enclosure is to house the shelving used as holding trays for dehydration of fruits and vegetables or the like for the primary purpose of dehydration.

While these steps are taking place, the machine is creating moisture from the air and making pure dispensable drinking water. The water collection tanks, as well as all of the tubing in this process, may be made up of any suitable antibacterial FDA-approved material. The collection tank located at the bottom of the unit is mounted on sliding tracks for ease of removing cleaning and reinstalling for sanitation purposes. Separated atmosphere stored in the antibacterial collection tank is pumped through a five-stage Pi filtration to assure safety against intake of volatile organic compounds, voc's, bacteria and viruses, that may enter from the atmosphere before passing to the top antibacterial holding tank, where the colloidal silver pulsar generates. Further steps to prevent growth of organisms and contaminants are created by continuous aquarium-style rotating movement of the collected atmosphere through the Pi filtration system. An optional reverse osmosis system may be used in place of four of the stages along with the Pi Filters. The dispensed air for dehydration is purified on both the intake and the exit for safety in preventing contamination of fruits and vegetables.

A whisper-quiet fan may be used which heats while running across a heat evaporator exchange. The heated air is then dispensed out from the backside of the housing at a fully open rate of 1725 rpms, where freestanding shelves holding fruits and vegetables or the like receive the heated airflow and therefore dehydrate the contents. Inside of the duct, there is an adjustable baffle slowing down the amount of heated airflow to slow the process of dehydration if so desired. The baffle may be left fully opened for quicker dehydration. When the outside ambient air has levels of humidity within its atmosphere, the whisper-quiet fan draws the humid air into the primary housing through the air inlet across atmospheric chilling collection coils, separating the atmospheric humidity from the ambient air for purifying, becoming concentrated humidity which is water which may be used for dispensing and human consumption. The entire unit may be powered from mains or portable generators, AC, 110–220 V, 50–60 Hz, or from DC power, 6–60 V batteries.

The portable, atmospheric dehydrator and water condenser dispenser includes air filters which remove suspended pollen or dust particles so that contaminants and undesirable impurities from the environmental air are not carried into the dehydrator and water condenser dispenser section. The portable, atmospheric dehydrator and water condenser also includes a sterilization system, which provides purified liquid water that is filtered, heated, and chilled, at multiple temperatures ranging from 34° F. to 190° F., providing hot and cold purified water for all uses from iced tea to hot coffee.

This portable dehydration and water condensation unit may have a primary housing that is an attractive kitchen appliance and that can be supplied with an exterior skin (e.g., panels 1, 111, 112, 113 and 115) made with a high quality plastic front, powder-coated metal sides, similar to that of a refrigerator, or an upgraded style of stainless steel to match that of many kitchens where all appliances are that of stainless steel.

The air inlet where the air filter is located is easily removable making it possible to easily clean the air filter for smooth clean operation of the invention. The whisper-quiet fan assures as low of a db level as possible to make it quite enough for inside homes and offices. The atmospheric chilling collection coils may be coated with the same FDA-approved coating used on the inside walls of city plumbing water lines, and has life of more than 50 years. The compressed heat created in the primary housing is dry enough to dehydrate fruits and vegetables or the like in the portable dehydration enclosure when exterior humidity levels are as high as 100%.

The invention may have two top lids. One may be for decoration and may be removable; the second may be able to hold a standard two or five-gallon bottled water. Antibacterial collection tank holding tanks are used for both the bottom and the top holding tanks. The hot and cold dispenser tanks are both stainless steel. Another unique feature is the five-stage Pi water filter system. Pi-Water is drinkable energy. Regular drinking and bottled water are merely cleaned and filtered. Pi-Water takes water to the next level by passing on its energy to its consumer. The effect of Pi-Water on living things is remarkable. Plant growth and heartiness are visibly noticeable. Salt water and freshwater fish are able to live in the same tank. Completely unique to this invention is the most complete water treatment system of any kind for purity and safety. It contains UV lamps in an aluminum housing, antibacterial tubing and tanks, a colloid silver pulsar, minerals in the mineral dispensers, an Ozoneator in the bottom tank, a Ste-O-Tap (U/F) filter, not to mention the matrix+one filter, and the Pi filter itself. The entire system operates like an aquarium, continuously circulating.

Both the separate housings have wheels and are portable. There sealed containers and screened vents make them completely rodent and insect-free.

Also unique in this invention is that the 12-volt adapter makes it convenient to charge cell phones, power CD players, electric shavers, and all other devices that operate off of a 12-volt power supply.

None of the prior art patents discussed above include any of the following:

a. 12-volt inverter adapter with an automobile style cigarette lighter-type insert allowing one to insert and operate anything, such as a portable CD player, shaver, cell phone, or anything else that runs off of 12 volts.

b. Portable-dehydrating adjustable shelves.

c. Portable flexible duct system for connecting a portable dehydration housing to the atmospheric dehydrator and water condenser dispenser.

d. Easily attachable clips for connecting or removing the duct from the portable dehydration housing.

e. Easily attachable clips for connecting or removing the duct from the portable, atmospheric dehydrator and water condenser dispenser.

f. An attachable portable dehydration housing with a hinged swing-open front door and back inlet with easily attachable clips for connecting or removing the duct from the back of the portable dehydration housing. A portable dehydration housing which can be moved away from the atmospheric dehydrator and a water condenser dispenser for the convenient placement of the housing in a home or office.

g. Baffled ducts for controlling air flow to a portable dehydration housing for controlling airflow volume and dehydration time.

h. Five Stage Pi Filtration System Pi filter. When ferric/ferrous salt (Fe) receives cosmic energy waves, a change occurs in the nuclear and electron spin of the iron atom that causes the atom to be in a highly energized state. The highly energized iron atom radiates electromagnetic waves, or energy.

i. Aquarium-style operation continues circulation of continuous movement of concentrated humidity, continually adding oxygen to the water.

j. Replaceable adaptable top lid for adding bottled water such as a standard 5-gallon bottle.

k. Colloidal Silver pulsar generates the finest quality ionic colloidal silver.

l. Ozoneator means to ozonate or ozonize water to raise the oxygen content by bubbling ozone through water.

m. Replaceable mineral container. The mineral dispenser is an easily accessible dispenser which may have twist-on threads connecting two parts together which are sealed with an FDA-approved rubber sealed gasket to complete a seamlessly tight connection. The dispenser assures the ease of replacement or removal of such minerals.

n. Two top lids. One is for decoration which may be removable, and the second being underneath and able to hold a standard two or five-gallon bottled water.

o. Antibacterial tubing and holding tanks.

p. A whisper-quiet fan.

q. A remote control controlled LED-monitoring system with adjustable pH.

r. Individual atmospheric chilling collection coated fins.

s. Enclosed aluminum housing which reflects the UV lamp at it's highest exposure level and reduced sized inlets and outlets to restrict the flow of water entering and exiting the aluminum housing therefore creating more exposure time to the UV eight quartz lamp.

Any suitable components may be used. The various components are off the shelf items easily available and assembled by one skilled in the art.

Although a particular embodiment of the invention has been disclosed, variations thereof may occur to an artisan and the scope of the invention should only be limited by the scope of the appended claims.

We claim:

1. A method for dehydrating fruits or vegetables or the like comprising the steps of:

drawing ambient air across cooling means thereby cooling said ambient air; heat exchanging the cooled air and dispensing the same as heated air across a storage chamber adapted to hold therein fruits or vegetables or the like to remove moisture therefrom;

transferring the moisture removed from said fruits or vegetables or the like to a filtering system thereby filtering and purifying said removed moisture to form potable water.

2. The method of claim 1 wherein the step of drawing said air includes the step of intaking said air through a whisper-quiet fan while filtering the same.

3. The method of claim 1 wherein the step of dispensing said heated air to said fruits or vegetables or the like includes the step of passing said heated air through a panel having a plurality of spaced open louvers therein.

4. The method of claim 1 wherein the step of dispensing said heated air includes the step of passing said heated air through a duct to said fruits or vegetables or the like.

5. The method of claim 4 wherein the step of passing said heated air through a duct includes the step of baffling said air while passing the same through said duct to control the rate of speed of said air within said duct while passing it therethrough.

6. The method of claim 1 wherein the step of transferring said moisture includes the step of passing said moisture through a filter prior to passing the same into a holding tank.

7. The method of claim 6 including the step of monitoring the level of water in said holding tank to draw said ambient air across said cooling means when said level reaches a predetermined lower level in said holding tank.

8. The method of claim 7 wherein the step of filtering said water includes the step of passing said water through an ultra violet light.

9. A method for dehydrating fruits or vegetables or the like comprising the steps of:

drawing ambient air across cooling means thereby cooling said ambient air; heat exchanging the cooled air and dispensing the same as heated air across a storage chamber adapted to hold therein fruits or vegetables or the like to remove moisture therefrom;

transferring the moisture removed from said fruits or vegetables or the like to a filtering system thereby filtering and purifying said removed moisture to form potable water;

wherein the step of transferring said moisture includes the step of passing said moisture through a filter prior to passing the same into a holding tank;

the method further including the step of monitoring the level of water in said holding tank to draw said ambient air across said cooling means when said level reaches a predetermined lower level in said holding tank; and wherein the step of filtering includes the step of passing said water successively through a five stage Pi filtration comprising:

a first sediment filter;

a second micron matrix+one filter;

a third ste-o-tap filter;

a fourth post carbon filter; and a fifth Pi filter.

10. The method of claim 9 including the step of transferring the filtered water from said fifth Pi filter to a second holding tank.

11. The method of claim 10 including the step of transferring condensation from said step of cooling said first mentioned holding tank remote from said second holding tank.

12. The method of claim 11 including the step of adding minerals to said water being transferred from said second holding tank to a cold water dispenser.

13. The method of claim 12 including the step of removing water from said second holding tank to said cold water dispenser.

14. The method of claim 12 including the step of removing water from said second holding tank to a hot water dispenser while heating the same.

15. A method for dehydrating fruits or vegetables or the like comprising the steps of:

drawing ambient air across cooling means thereby cooling said ambient air; heat exchanging the cooled air and dispensing the same as heated air across a storage chamber adapted to hold therein fruits or vegetables or the like to remove moisture therefrom;

transferring the moisture removed from said fruits or vegetables or the like to a filtering system thereby filtering and purifying said removed moisture to form potable water; and treating said potable water to add colloidal silver thereto.

16. Apparatus for dehydrating fruits or vegetables or the like comprising:

a housing;

ambient air intake means mounted in said housing;

cooling means mounted in said housing in fluid communication with said air being drawn into said housing through said intake means;

heat-exchanging means in fluid communication with air cooled by said cooling means for heating said cooled air;

a storage chamber associated with said housing having a plurality of spaced shelves adapted to hold fruits or vegetables or the like thereon;

heated air dispersion means associated with both said heat exchanging means and said shelves for dispersing said heated air into contact with said shelves thereby dehydrating fruits or vegetables or the like on said shelves;

transferring moisture from said dried fruits or vegetables or the like to a filtering system; and filtering means in said system for filtering and purifying said removed moisture.

17. The apparatus of claim 16 wherein said dispersion means includes a panel having a plurality of spaced open louvers between said heat exchanging means and said shelves in the path of said heated air from said heat exchanging means.

18. The apparatus of claim 16 wherein said dispersion means includes a duct between said heat exchanging means and said shelves in fluid communication therewith.

19. The apparatus of claim 18 wherein said duct is baffled on the interior thereof to control the rate and flow of air therethrough.

20. The apparatus of claim 18 including a first water holding tank in fluid communication with said cooling means.

21. Apparatus for dehydrating fruits or vegetables or the like comprising:

a housing;

ambient air intake means mounted in said housing;

cooling means mounted in said housing in fluid communication with said air being drawn into said housing through said intake means;

heat-exchanging means in fluid communication with air cooled by said cooling means for heating said cooled air;

a storage chamber associated with said housing having a plurality of spaced shelves adapted to hold fruits or vegetables or the like thereon;

heated air dispersion means associated with both said heat exchanging means and said shelves for dispersing said heated air into contact with said shelves thereby dehydrating fruits or vegetables or the like on said shelves;

means for transferring moisture from said dried fruits or vegetables or the like to a filtering system; and filtering means in said system for filtering and purifying said removed moisture;

wherein said dispersion means includes a duct between said heat exchanging means and said shelves in fluid communication therewith; and wherein said filtering system includes five stage Pi filtration comprising:

a first sediment filter;

a second micron matrix+one filter in fluid communication with said first filter;

a third ste-o-tap filter in fluid communication with said second filter;

a fourth post carbon filter in fluid communication with said third filter; and a fifth Pi filter in fluid communication with said fourth filter.

22. The apparatus of claim 21 including a second water holding tank in fluid communication with said fifth filter.

23. The apparatus of claim 22 including mineral adding means associated with said second holding tank and a cold water dispenser in fluid communication with said second holding tank for adding minerals to said water.

24. The apparatus of claim 22 including a hot water dispenser having heating means associated therewith in fluid communication with said second holding tank.

25. The apparatus of claim 1 including a computer mounted in said housing for operating said apparatus.

26. The apparatus of claim 25 including a 12-volt inverter adapter mounted on said housing.

27. Apparatus for dehydrating fruits or vegetables or the like comprising:

a housing;

ambient air intake means mounted in said housing;

cooling means mounted in said housing in fluid communication with said air being drawn into said housing through said intake means;

heat-exchanging means in fluid communication with air cooled by said cooling means for heating said cooled air;

a storage chamber associated with said housing having a plurality of spaced shelves adapted to hold fruits or vegetables or the like thereon;

heated air dispersion means associated with both said heat exchanging means and said shelves for dispersing said heated air into contact with said shelves thereby dehydrating fruits or vegetables or the like on said shelves;

means for transferring moisture from said dried fruits or vegetables or the like to a filtering system; and filtering means in said system for filtering and purifying said removed moisture;

the apparatus including silver adding means associated with said potable water for adding colloidal silver to same water.

28. A portable dehydration and water condensation system for dehydrating fruits or vegetables or the like comprising:

a. A dehydrator for holding fruits or vegetables or the like;

b. humidity removal means for drawing humid ambient air from the atmosphere for removing humidity from said ambient air thereby forming dry heated air; and c. dispensing means for dispensing said dry heated air to said dehydrator to thereby dehydrate said fruits or vegetables or the like and remove moisture therefrom;

d. including the step of recovering moisture from said fruits or vegetables after dehydrating the same and purifying said moisture to form potable drinking water.

* * * * *